US009810226B2

(12) United States Patent
Micheli et al.

(10) Patent No.: US 9,810,226 B2
(45) Date of Patent: Nov. 7, 2017

(54) AXIAL COMPRESSOR

(71) Applicant: ALSTOM Technology Ltd, Baden (CH)

(72) Inventors: Marco Micheli, Wettingen (CH); Wolfgang Kappis, Fislisbach (CH); Luis Federico Puerta, Rieden (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 777 days.

(21) Appl. No.: 13/917,933

(22) Filed: Jun. 14, 2013

(65) Prior Publication Data

US 2013/0280053 A1 Oct. 24, 2013

Related U.S. Application Data

(63) Continuation of application No. PCT/EP2011/072052, filed on Dec. 7, 2011.

(30) Foreign Application Priority Data

Dec. 15, 2010 (CH) ..... 2093/10

(51) Int. Cl.

| | |
|---|---|
| ***F01D 5/14*** | (2006.01) |
| ***F04D 19/00*** | (2006.01) |
| ***F04D 29/54*** | (2006.01) |

(52) U.S. Cl.

CPC ..... *F04D 19/00* (2013.01); *F01D 5/142* (2013.01); *F01D 5/146* (2013.01); *F04D 29/544* (2013.01); *F05D 2250/34* (2013.01); *F05D 2250/38* (2013.01)

(58) Field of Classification Search

CPC ..... F04D 29/526; F04D 29/541; F04D 29/44; F04D 29/444; F04D 29/54; F04D 29/542; F04D 19/00; F01D 5/142; F01D 5/146; F01D 9/041; F05D 2240/12; F05D 2240/129; F05D 2240/14; F05D 2250/30; F05D 2250/37; F05B 2240/124

See application file for complete search history.

(56) References Cited

U.S. PATENT DOCUMENTS

| | | | | |
|---|---|---|---|---|
| 2,798,661 | A | 7/1957 | Willenbrock et al. | |
| 4,011,028 | A | 3/1977 | Borsuk | |
| 4,874,289 | A | 10/1989 | Smith, Jr. et al. | |
| 2008/0003098 | A1 * | 1/2008 | Micheli | F04D 29/541 415/129 |

(Continued)

FOREIGN PATENT DOCUMENTS

| | | | |
|---|---|---|---|
| DE | WO 2010063575 A1 * | 6/2010 | F01D 11/001 |
| EP | 0 343 888 | 11/1989 | |
| EP | 2 218 876 | 8/2010 | |

(Continued)

*Primary Examiner* — Dwayne J White
*Assistant Examiner* — Danielle M Christensen
(74) *Attorney, Agent, or Firm* — Buchanan Ingersoll & Rooney PC

(57) ABSTRACT

The axial compressor has a two-stage guide vane cascade at the discharge-side end of the rotor. The guide vanes of the second stage of the cascade are staggered in the circumferential direction in relation to the guide vanes of the first stage in such a way that vortex streamers created by the guide vanes of the first stage cannot impinge upon the guide vanes of the second stage.

2 Claims, 3 Drawing Sheets

(56) References Cited

U.S. PATENT DOCUMENTS

| | | | | |
|---|---|---|---|---|
| 2010/0303629 | A1* | 12/2010 | Guemmer | F01D 5/146<br>416/223 R |
| 2011/0318172 | A1 | 12/2011 | Hoeger | |

FOREIGN PATENT DOCUMENTS

| | | | |
|---|---|---|---|
| GB | 628263 | | 8/1949 |
| JP | 62-45397 | | 3/1987 |
| JP | 2010-151134 | | 7/2010 |
| SU | 1366722 | A1 | 1/1988 |

* cited by examiner

AXIAL COMPRESSOR

CROSS-REFERENCE TO RELATED APPLICATIONS

This application claims priority to PCT/EP2011/072052 filed Dec. 7, 2011, which claims priority to Swiss Application Number 02093/10 filed Dec. 15, 2010, both of which are hereby incorporated in their entireties.

TECHNICAL FIELD

The invention relates to an axial compressor having two-stage guide vane cascade at the discharge-side end of the rotor. Specifically, the invention relates to an axial compressor wherein the guide vanes of a second stage of the cascade are staggered in the circumferential direction in relation to the guide vanes of a first stage in such a way that vortex streamers created by the guide vanes of the first stage cannot impinge upon the guide vanes of the second stage.

BACKGROUND

Axial compressors are generally known. In this case, it concerns turbomachines having a rotor which is arranged inside a casing which is subjected to axial throughflow, and which normally has a plurality of rotor blade stages, i.e. rotor-side rotor blade rows with circumferentially adjacent rotor blades for the compressor operation. Stationary casing-side stator blade rows are provided between axially adjacent rotor blade rows in each case in order to deflect the fluid, which is to be compressed, on its path to the axially following rotor blade stage into an inflow direction which is optimum for it. Also, a stationary guide vane arrangement or cascade is provided downstream of the rotor-blade final stage of the rotor in order to convert the swirled flow of fluid, which is brought about by the rotor, into an essentially axial flow. In this way, high axial flow velocities can be achieved so that the kinetic energy of the flow medium which is associated therewith can be converted into potential energy (pressure).

Known in addition to single-stage guide vane cascades with so-called super guide vanes are multistage guide vane cascades in which a plurality of guide vane rows, consisting in each case of guide vanes which are adjacent in the circumferential direction of the casing, are arranged axially in series (without axial overlapping).

One advantage of such an arrangement is to be seen as that of the guide vanes being able to have comparatively simply producible profiles and being able to be optimized more easily with regard to their aerodynamics.

SUMMARY

In this case, the invention is based on the knowledge that even aerodynamically optimized profiles of a multistage guide vane cascade downstream of the rotor-blade final stage of the rotor regularly only lead to a sub-optimum result, especially to the occurrence of pressure pulsations with intense noise in the flow medium.

Therefore, it is the object of the invention to create an axial compressor with an optimum multistage guide vane cascade.

This object is achieved according to the invention by all the guide vanes of the guide vane cascade being at a distance by the same arcuate dimension from its guide vanes which are adjacent in the circumferential direction of the casing, and by the axially following guide vane stage being arranged in each case in a circumferentially staggered manner in relation to the preceding guide vane stage in such a way that vortex streamers, which are created by the guide vanes of the preceding stage, flow through in each case between adjacent guide vanes of the following guide vane stage.

The invention is based on the general idea—in the case of guide vane stages axially arranged in series—of ensuring an inflow which is as swirl-free as possible in the guide vanes which are located downstream.

In order to achieve the desired swirl-free inflow of the guide vanes which follow in the flow direction, the previous constructional form of multistage guide vane cascades is abandoned using the invention. Previously, in the case of guide vane stages arranged in series, different distances were provided between circumferentially adjacent guide vanes, i.e. greater arcuate distances existed in the circumferential direction between the guide vanes of a guide vane stage following in the flow direction than between the guide vanes of the guide vane stage preceding in the flow direction in each case. Therefore, it was impossible in principle to keep the vortex streamers of the guide vanes of the preceding guide vane stage away from the leading edges of the guide vanes of the following guide vane stage in a reproducible manner.

In the case of the invention, this is easily possible because equal arcuate distances exist in the circumferential direction between the guide vanes of the preceding guide vane stage and the guide vanes of the following guide vane stage, so that the following guide vane stage, in relation to the preceding guide vane stage, only has to be arranged in a staggered manner by a predetermined arcuate dimension in order to bring about a relatively swirl-free inflow of the guide vanes of the following stage.

According to a preferred embodiment of the invention, it can be provided that the vortex streamers have a smaller distance from the convexly curved side of the one adjacent guide vane of the following guide vane stage than from the concavely curved side of the other adjacent guide vane.

In this way, the vortex streamers find their way into the comparatively fast circumflow of the convexly curved guide vane side so that the vortices are "smoothed" comparatively effectively.

It has proved to be advantageous if the dimensions of the two distances according to order of magnitude are approximately 1:2 to 1:1.

In a constructionally preferred manner, it can be provided according to the invention to assemble the casing of the axial compressor, in a basically known manner, from circumferentially adjoining shell sections, and to arrange in each case an inner wall segment, which predetermines the circumferential spacing of the adjacent guide vanes, between circumferentially adjacent guide vanes of the guide vane cascade. In this context, it is advantageously provided to arrange a split inner wall segment on a parting plane between adjacent shell sections of the casing, in fact in such a way that the parting plane between the segment sections coincides with the parting plane between the shell sections of the casing. If now the segment sections of the series-arranged guide vane stages of the cascade are dimensioned in accordance with the stagger of the guide vanes in the circumferential direction which is provided between these stages, the guide vanes of the guide vane cascade are arranged according to the invention without further measures if the parting planes of the shell sections and segment sections coincide.

With regard to advantageous features, reference is otherwise made to the claims and to the subsequent explanation of the drawing, on the basis of which an especially preferred embodiment of the invention is explained in more detail.

Protection is claimed not only for disclosed or depicted feature combinations but also for principally any combinations of the disclosed or depicted individual features.

DETAILED DESCRIPTION

Figure 1:
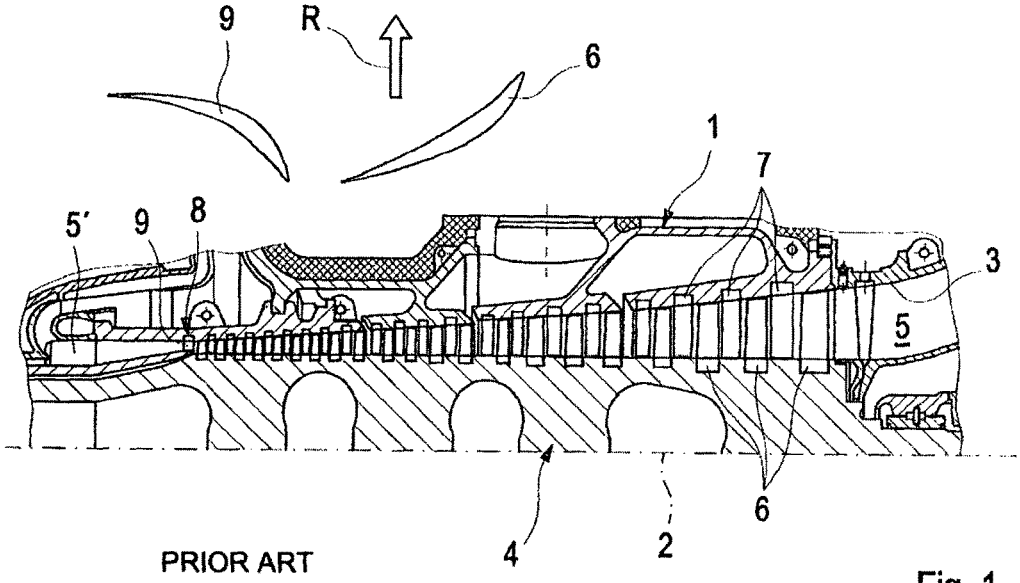
FIG. 1 shows a schematized axial section of a conventional axial compressor with a discharge-side guide vane cascade which consists of so-called super guide vanes.

In FIG. 1, a conventional axial compressor is shown. This, in a known way, has a casing 1 with an inner wall 3 which is essentially rotationally symmetrical to a rotor axis 2. The casing 1 encloses a rotor 4 which is arranged axially between an inlet 5 for a flow medium which is to be compressed and an outlet 5' which as a rule leads to a combustion chamber.

Rotor blades 6, fixed to the rotor, specifically in rotor blade rows or rotor blade stages which extend in the circumferential direction of the rotor in each case, are arranged on the rotor 4 in a known manner. Stator blades 7, fixed to the casing, specifically in stator blade rows or stages which extend in the circumferential direction of the casing inner wall 3 in each case, are arranged in each case between axially adjacent rotor blade stages.

Provided axially downstream of the rotor blade final stage of the rotor 4 is a single-stage guide vane arrangement or guide vane cascade 8 which comprises so-called super guide vanes 9. These super guide vanes have a distinctly curved profile and are arranged in such a way that they eliminate the intense swirl of the flow medium on the discharge side of the rotor 1 and create a largely axial flow of the medium.

Figure 2:
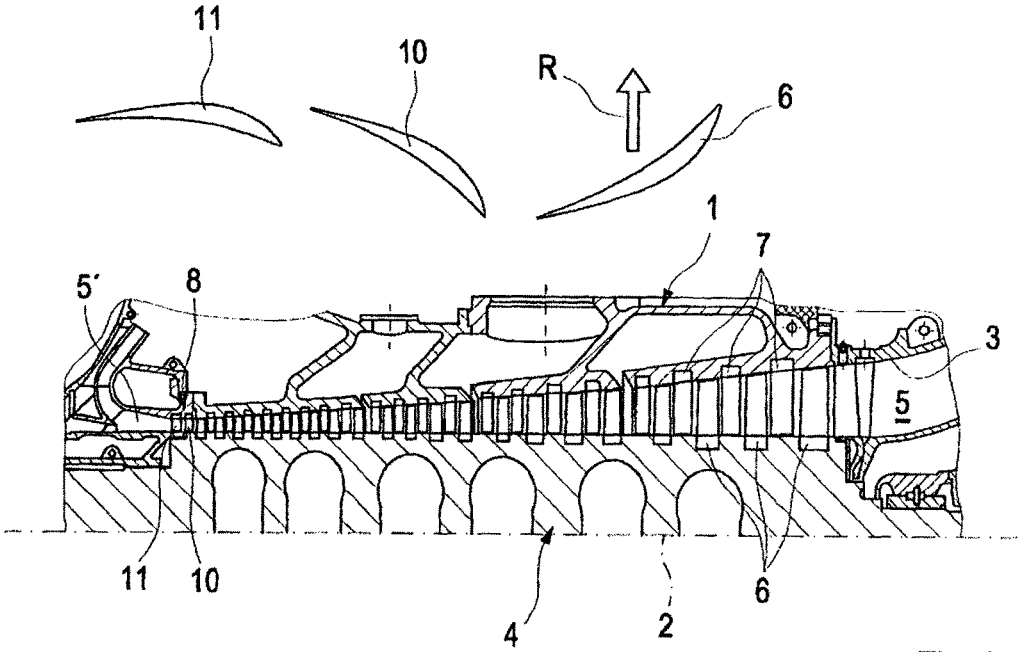
FIG. 2 shows a schematized axial section of an axial compressor with a two-stage guide vane cascade arranged on the discharge side of the rotor.

The axial compressor which is shown in FIG. 2 differs from the axial compressor of FIG. 1 essentially only in that the guide vane cascade 8 is a two-stage construction with "normal" guide vanes 10 and 11 which have a profile which is curved to a lesser degree in comparison.

The type of construction of an axial compressor which is shown in FIG. 2 is basically known and is also provided in the case of the invention.

Figure 3:
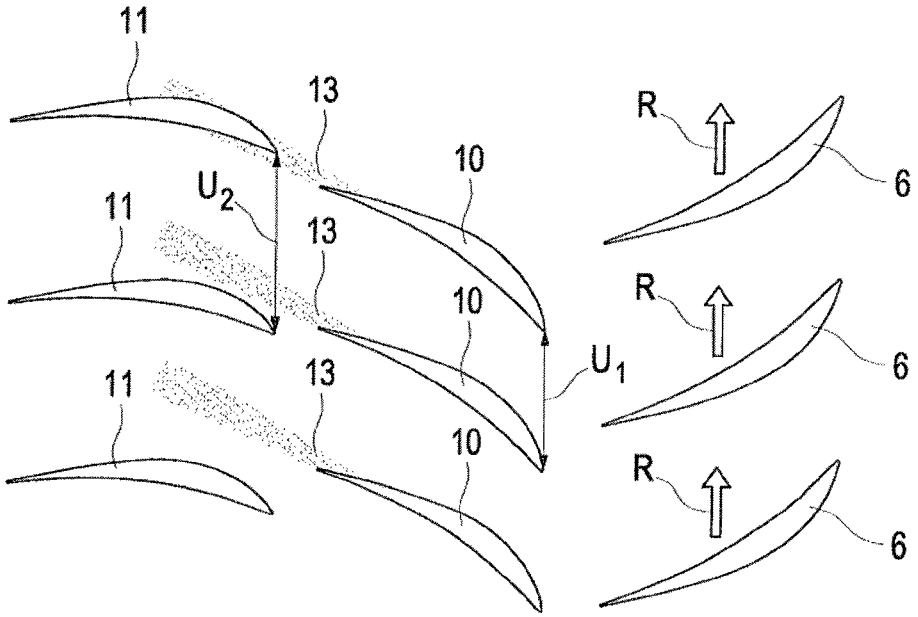
PRIOR ART Fig. 3
FIG. 3 shows a sectional drawing in detail of a conventional two-stage guide vane cascade, wherein all the vane profiles are shown in relation to a developed view of an inner wall of the compressor casing.
Figure 4:
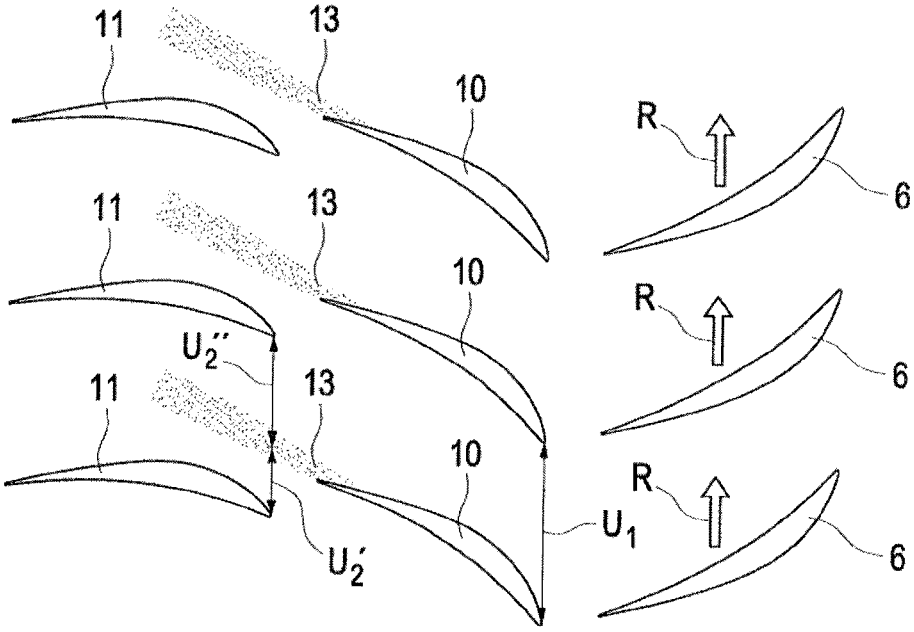
FIG. 4 shows a view according to FIG. 3 of a guide vane cascade according to the invention.

FIGS. 3 and 4 show the differences of the invention compared with previous constructions. In FIG. 3, the relative positions of the guide vanes 10 and 11 of a two-stage conventional guide vane cascade are shown. In particular, it becomes apparent that the leading edges of the front guide vanes 10, in the flow direction, of the front guide vane stage have a distance $U_1$ in the circumferential direction, whereas the guide vanes 11 of the following guide vane stage have a distance $U_2$ in this direction which deviates therefrom. This inevitably leads to vortex streamers 13, which are created by the front guide vanes 10, at least partially directly impinging upon the leading edge of a guide vane 11 of the following guide vane stage. As a result, the efficiency of the guide vane cascade and correspondingly also the efficiency of the axial compressor are negatively affected, however.

In the case of the invention, on the other hand, according to FIG. 4, the distances $U_1$ and $U_2$ have equal dimensions so that by a corresponding stagger of the guide vanes 11 of the following guide vane stage in the circumferential direction it can be ensured that the vortex streamers 13 pass between circumferentially adjacent guide vanes 11 in each case. The arrangement of the guide vanes 10 and 11 is preferably designed so that the vortex streamers 13 are guided in comparatively closer proximity past the convexly curved sides of the lower guide vanes 11 in the drawing in each case. In this case, the distances $U'_2$ and $U''_2$, as $U'_2:U''_2$,=1:2.

As a result, the effect is therefore achieved of the vortex streamers 13 finding their way into the comparatively fast circumflow of the convex guide vane sides.

Figure 5:
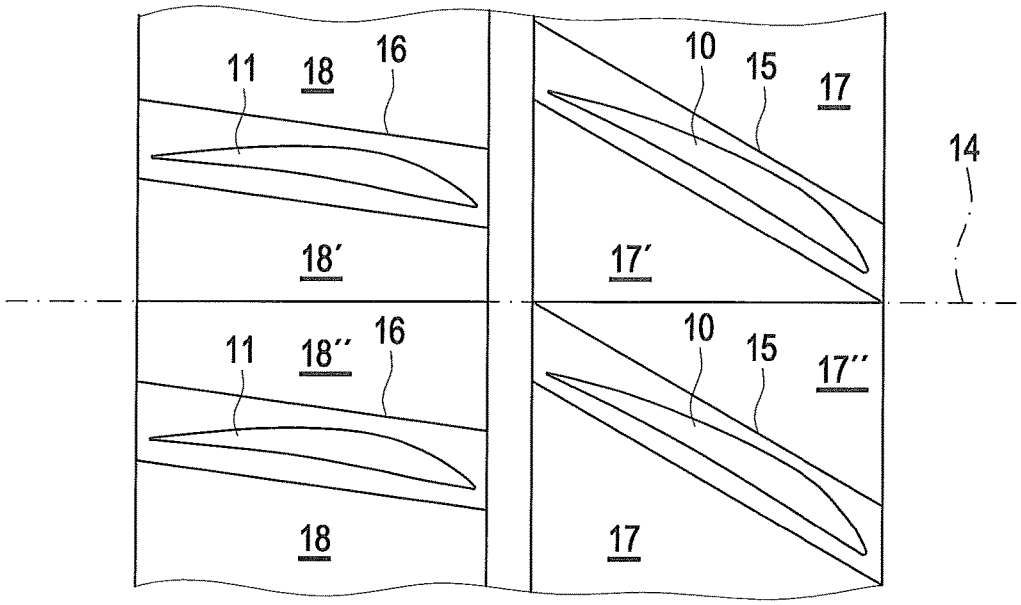
FIG. 5 shows a plan view of an inner wall section of the compressor casing, in a developed view, in the region of the discharge-side guide vane cascade.

In order to achieve the desired stagger in the circumferential direction between the guide vane stage formed by the guide vanes 10 and the guide vane stage formed by the guide vanes 11 during assembly of the axial compressor, a construction according to FIG. 5 is preferably provided.

In a basically known manner, the compressor casing is assembled from shell sections which are placed against each other on a parting plane 14. On the inner side of these shell sections, the guide vanes 10 and 11 are installed in a conventional way, for example by the roots 15 and 16 of the guide vanes 10 and 11, by anchors formed upon them, being inserted in the circumferential direction into a channel which is formed in the inner side of the respective shell section. Arranged in each case between circumferentially adjacent roots 15 or 16 is an inner wall segment 17 or 18 which is dimensioned so that the arcuate dimensions $U_1$ and $U_2$ apparent from FIG. 4, which have the same values, exist between the leading edges of the guide vanes 10 and 11. Segmented wall segments, with the segment sections 17' and 17" or 18' and 18", are provided in each case in the region of the parting plane 14, wherein the respective segment sections 17' and 17" or 18' and 18" are positioned so that their parting plane coincides with the parting plane 14 of the casing shell sections. With corresponding dimensioning of the segment sections 17' and 18' and also 17" and 18", the desired stagger in the circumferential direction between the guide vanes 10 and 11 is ensured in this way.

In FIGS. 1 to 5, one or more of the rotor-side rotor blades 6 of the final rotor blade stage are schematically also shown in profile in each case, wherein R refers to the rotational direction of the rotor 4.

What is claimed is:

1. An axial compressor, comprising:

a rotor rotatably arranged in a casing, the rotor comprising:

a plurality of rotor blade stages;

a multistage guide vane cascade arranged in a stationary manner in the casing on a discharge side of a rotor-blade final stage of the rotor and which has axially arranged guide vane rows without axial overlapping;

wherein the guide vanes of a preceding guide vane row are at a same arcuate distance to adjacent guide vanes in the circumferential direction of the casing, as guide vanes in an axially following guide vane row and the axially following guide vane row is arranged in each case in a circumferentially staggered manner in relation to the preceding guide vane row in such a way that vortex streamers, which are created by the guide vanes of the preceding row, flow through in each case between adjacent guide vanes of the following guide vane row, wherein an arcuate distance $U'_2$ from the vortex streamers to a leading edge of a convexly curved side of one guide vane of the following guide vane row is smaller than an arcuate distance $U''_2$ from the vortex streamers to a leading edge of a concavely curved side of an adjacent guide vane of the following guide vane row in the circumferential direction of the casing and the two distances ($U'_2$, $U''_2$) are related to each other according to an order of magnitude of approximately $1:1>U'_2:U''_2>1:2$.

2. The axial compressor according to claim 1, wherein the casing is assembled from circumferentially adjoining shell sections, and an inner wall segment, which predetermines the spacing of the guide vanes in the circumferential direction, is arranged in each case between circumferentially adjacent guide vanes of the cascade, wherein on a parting plane between adjacent shell sections of the casing provision is made for a split inner wall segment, of which the parting plane between the segment sections coincides with the parting plane between the shell sections of the casing, wherein the segment sections of the axially series-arranged guide vane rows are dimensioned so that the two guide vane rows have a predetermined stagger in the circumferential direction.

* * * * *